United States Patent [19]

Gerch et al.

[11] Patent Number: 4,819,796

[45] Date of Patent: Apr. 11, 1989

[54] EXPANDABLE GARMENT CARRIER

[75] Inventors: Edward L. Gerch, Chicago; Warner D. Rosenfeld, Glencoe, both of Ill.

[73] Assignee: Kingport International Corporation, Evanston, Ill.

[21] Appl. No.: 162,424

[22] Filed: Mar. 1, 1988

[51] Int. Cl.[4] ..... A45C 7/00; A45C 13/00; B65D 85/18

[52] U.S. Cl. ..... 206/291; 190/13 F; 190/14; 190/103; 190/111; 206/292; 383/2

[58] Field of Search ..... 206/278, 279, 287, 287.1, 206/289, 290, 291, 284, 285, 292; 190/13 R, 13 F, 103–105, 14; 211/94, 124; 383/2

[56] References Cited

U.S. PATENT DOCUMENTS

| | | | |
|---|---|---|---|
| 2,003,100 | 5/1935 | Arpin | 206/287.1 X |
| 2,285,745 | 6/1942 | Ritter, Jr. | 211/94 |
| 2,635,721 | 4/1953 | Suben | 190/14 |
| 3,115,959 | 12/1963 | Jaffe | 206/287.1 |
| 3,126,076 | 3/1964 | Koffler | 211/94 X |
| 3,141,535 | 7/1964 | Hamilton | 190/13 R |
| 3,292,747 | 12/1966 | Dawson | 190/103 |
| 3,443,671 | 5/1969 | Dyke | 190/103 |
| 3,542,170 | 11/1970 | Bialo | 206/287.1 X |
| 3,647,035 | 3/1972 | Honig | 190/103 |
| 3,881,579 | 5/1975 | Keerdoja | 206/287 |
| 4,098,376 | 7/1978 | Pelavin | 190/113 |
| 4,361,215 | 11/1982 | Sawai | 383/2 |
| 4,585,127 | 4/1986 | Benedict | 211/94 X |

FOREIGN PATENT DOCUMENTS

| | | | |
|---|---|---|---|
| 163921 | 11/1954 | Australia | 190/104 |
| 512708 | 9/1939 | United Kingdom | 190/104 |

*Primary Examiner*—Sue A. Weaver

*Attorney, Agent, or Firm*—James N. Videbeck

[57] ABSTRACT

A garment carrier of the type including a generally rectangular outer panel and a like sized generally rectangular inner panel joined along their respective peripheries to the opposed sides of an elongate side panel extending around the peripheries of the outside and inside panels, with the garment carrier being foldable along a mid portion spine extending transversely of the outside panel. User carrying means including handles and/straps are fixable to the spine in a manner known in the art. The outside panel of the garment carrier includes a plurality of pockets positioned thereon with each pocket including an opening associated therewith, and a means for selectively closing said opening mounted adjacent each opening. An improvement in the garment carrier in an expansible elongate side panel extending substantially along the periphery of said garment carrier, and closure means positioned adjacent the respective side edges of said expansion panel along the length thereof for selectably folding and maintaining said expansible side panel in a non-expanded position as desired. The invention further resides in an expandable means for hanger support including articulated hanger retaining members which when folded will supported about half of the garment they will support when positioned in unfolded or extended position.

8 Claims, 3 Drawing Sheets

EXPANDABLE GARMENT CARRIER

BACKGROUND OF THE INVENTION

This invention relates to garment carriers and more particularly to soft sided foldable garment carriers of the type used as carry-on luggage by business and other travellers. Soft sided foldable garment carriers come in several basic sizes. First, garment carriers built for use mainly by men tend to have an unfolded length approximating 38–42 inches. This length is suitable for housing men's suit coat and pants therein. Soft sided garment carriers having a longer length approximating 46–50 inches are suited mainly for carrying women's clothes, namely, dresses. Likewise, there are several thicknesses of garment carriers. Very light, thin, garment carriers, usually made without a separate peripheral side panel, may be suitable for carrying one suit and a companion shirt. However, most garment carriers come in two basic sizes, identified in the trade as either a two suit garment carrier, or a four suit garment carrier. The thinner two suit garment carrier is used for short trips, such as business trips, where a couple of suits, or one suit and numerous shirts can be positioned in the garment carrier for trips of several days' length. A larger carry-on type garment carrier, designated a four suiter, is utilized for longer trips, vacations, and the like, where a substantial number of changes of clothes need to be taken with a traveller. The frequent business traveller may have use for a two suiter type garment carrier on most business trips. However, such a traveller may need a larger garment carrier for infrequent longer trips.

A need has developed for soft sided foldable garment carrier which may be used by business or other travellers for a substantial number of trips of several days' duration, while possessing expansibility in its structure and function for use as a larger garment carrier on infrequent or longer trips.

It is therefore an object of the present invention, generally stated, to provide an improved soft sided garment carrier having expansive capabilities for housing addditional clothing on longer trips, while having a basic size more suited to typical business trips of shorter duration.

SUMMARY OF THE INVENTION

The invention is directed to a garment carrier of the type being foldable along a transverse fold line. The garment carrier includes a generally rectangular outside panel and a similarly shaped inside panel each being joined along its periphery to at least one edge of an elongate side panel extending therearound. The garment carrier further includes means for manual user carrying thereof when in folded position. The invention is directed to an improvement comprising means for backfolding a portion of the side panel along its width substantially around the periphery of the garment carrier and selectably maintaining same in backfolded position for defining the basic size of the garment carrier, and for increasing the size of the garment carrier when the backfolded portion of the side panel is released to a fully extended position. The invention further includes expandable means for hanger support positioned on one end of the interior of the garment carrier.

BRIEF DESCRIPTION OF THE DRAWINGS

The features of the present invention, which are believed to be novel, are set forth in particularity in the appended claims. The invention may best be understood from the following detailed description of a currently preferred embodiment thereof taken in conjunction with the accompanying drawings wherein like numerals refer to like parts and in which:

DETAILED DESCRIPTION OF THE PREFERRED EMBODIMENT

Figure 2:
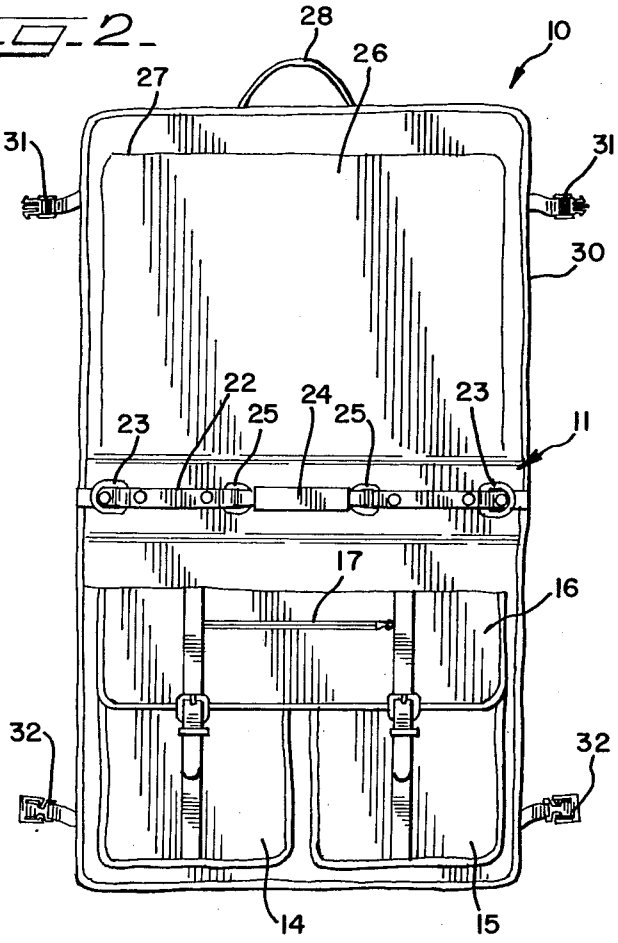
FIG. 2 is a top plan view of the garment carrier shown in FIG. 1 as it appear when unfolded so as to view the outside panel thereof.
Figure 3:
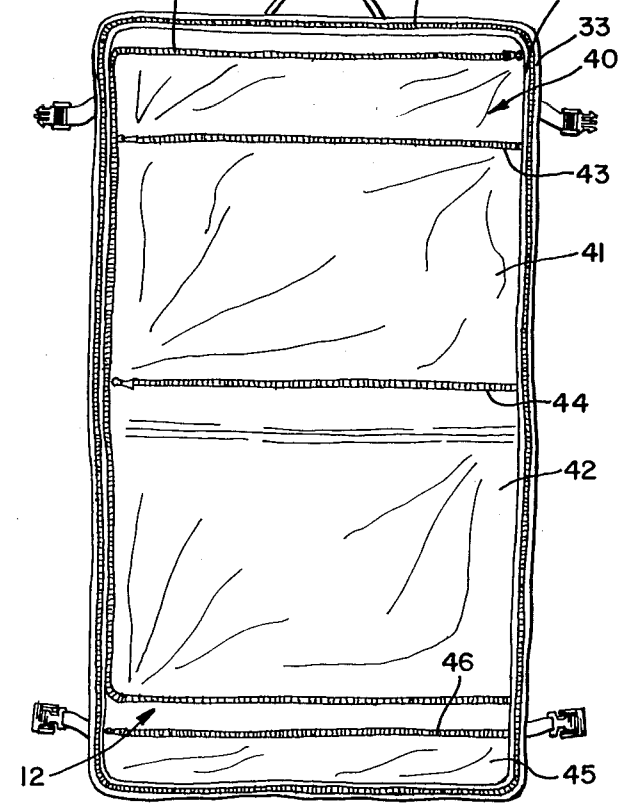
FIG. 3 is a bottom plan view of the garment carrier in its unfolded position shown in FIG. 2.

Referring to FIGS. 1–5, the soft sided, foldable garment carrier, generally indicated at 10 and constructed in accordance with the present invention, includes an outer panel, generally indicated at 11, which is shown most clearly in FIG. 2 in unfolded form, an inside panel, generally indicated at 12 and shown most clearly in FIG. 3, and an elongate side panel, generally indicated at 13, which extends around the peripheries of the outside panel 11 and inside panel 12 and is connected along its elongate side edges to each of panels 11 and 12.

Figure 1:
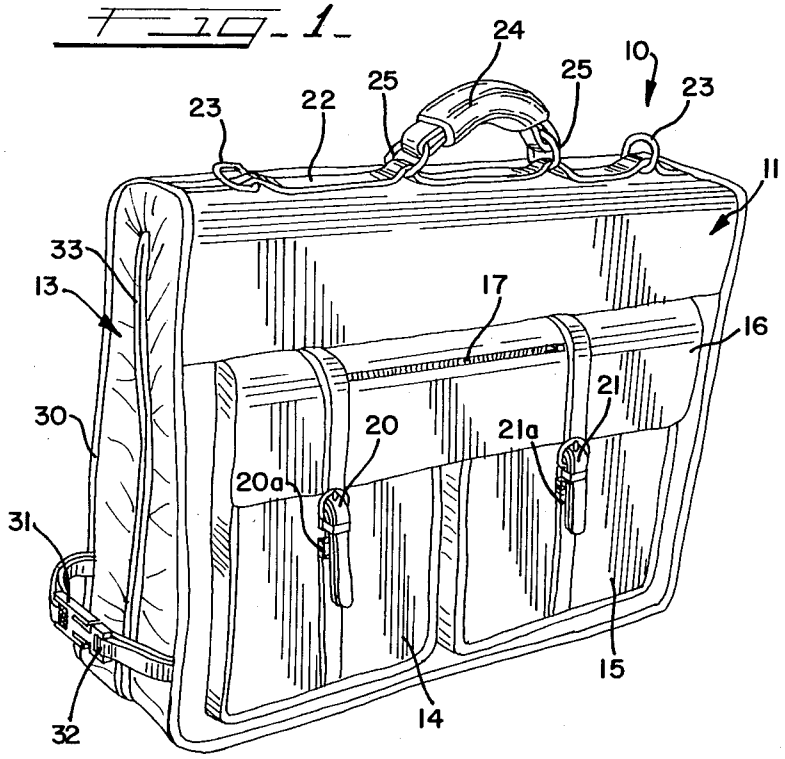
FIG. 1 is a perspective view of the garment carrier constructed in accordance with the present invention as shown in folded position suitable for user carrying.

As shown most clearly in FIGS. 1 and 2, the front portion of outside panel 11 includes a pair of pockets 14, 15 positioned vertically on the front panel 11 so that their top openings (not shown) are positioned under outer flap 16. In the preferred embodiment the top openings of pockets 14, 15 (not shown) are also selectably closable by slide fasteners (not shown). Outer flap 16 further includes therein a pocket whose opening is connected to and covered by slide fastener 17. In use, the pocket opening denoted at slide fastener 17 may be utilized to receive and retain airline tickets, hotel or car rental reservations, and the like which need to be easily and quickly retrieved by a user when boarding an airplane, checking into a hotel, etc. Flap 16 is further retained over pockets 14, 15 by dual combination buckle-snaps 20–21 which include as a part thereof an operating buckle, with an operating push release snap 20*a*, 21*a*, respectively positioned therebelow for ease and quickness of use.

At the top of FIG. 1, which is the middle of the outside panel 11 of garment carrier 10 is transversely positioned a spine or a frame member (not shown) immediately to the inside of outer panel 11. A long strap member 22 extends transversely and is fastened to the frame member across the middle of outer panel 11 and has fastened thereto adjacent the outer edges thereof a pair of shoulder strap loops 23—23, and a pliable handle 24 positioned thereon by means of handle loops 25—25.

On the back side of outer panel 11, a large pocket 26 is positioned with an opening 27 having a slide fastener (not shown) associated therewith subjacent the end of the garment carrier having a hand strap 28 and a hanger loop (not shown) affixed thereon. The hand strap and loop are affixed to a base plate 29 (FIG. 6) positioned on the interior of the garment carrier 10 and extending across at least a substantial portion of the width of the top of the garment carrier.

In this embodiment, a strip of elongate piping 30 extends completely around the outside of the outer panel 11 between that panel and the elongate side panel 13, as shown most clearly in FIGS. 1 and 2. A pair of male and female clasp members 31, 32, respectively, are positioned inbetween piping 30 and the elongate side panel 13 inwardly adjacent the top and bottom of the garment carrier in unfolded position as shown most clearly in FIG. 2 so as to be selectably releasably joinably when the garment carrier is folded in the position shown in FIG. 1. A second elongate piping 33 extends completely around the joinder of the elongate side panel 13 and what appears to be the inner panel 12. However, as shown most clearly in FIGS. 3 and 5, and in accordance with the present invention, an expansible backfolded additional side panel portion 34 extends between piping 33 and piping 35 which, in turn, is attached to inner panel 12. Outside of panel 34, which is made pliable and backfoldable material which may be lighter in weight than material used for outside panel 11 and side panel 13, two halves of a slide fastener 36—36 may be joined when expansible side panel 34 is backfolded so that the thickness of the garment carrier is reduced to that shown in FIG. 4 from that of the expanded position shown in FIG. 5. As shown most clearly in FIGS. 3 and 5, piping 35 is positioned to sit inside of piping 33 with slide fastener 36—36 positioned therebetween, and preferably at least partially covered by the piping members 33 and 35.

Figure 4:
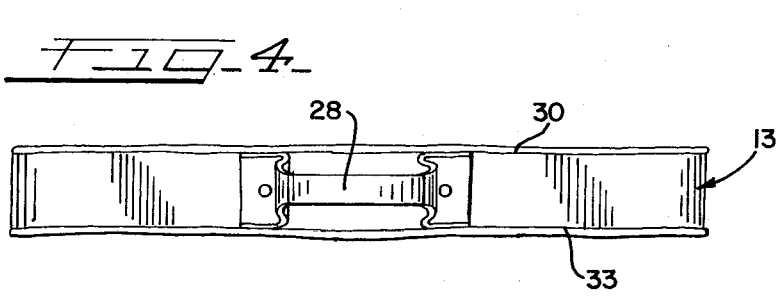
FIG. 4 is top elevational view of the garment carrier shown in FIG. 3.
Figure 5:
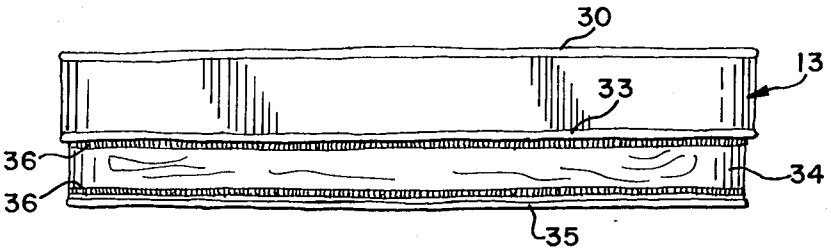
FIG. 5 is a bottom plan view of the garment carrier shown in FIG. 3 as it appears when the side panel of same is in expanded position.

As shown most clearly in FIG. 5, the expansible side panel 34 is sized to substantially double the width of thickness of the garment carrier 10 when it is in its expanded position, and yet as shown most clearly in FIG. 4, when the expandable side panel 34 is backfolded and retained in its substantially hidden position by a slide fastener 36, the garment carrier 10 of the invention looks and operates as a normal two-suiter type garment carrier.

Referring to FIG. 3, the inner panel 12 of the garment carrier 10 of the present invention is generally made of material which is lighter in weight than that used for outside panel 11, and includes in this preferred embodiment, a generally U-shaped opening defined by slide fastener 37 mounted therealong, which extends from the upper right hand corner of the inside panel as shown in FIG. 3 left to the upper left hand corner, then downwardly along the left hand side toward the lower bottom of garment carrier 10 and then, in this embodiment, approximately four to six inches above the bottom of the garment carrier, slide fastener and opening 37 turn right and extend again across the width of the garment carrier to terminate near the lower right hand corner of the garment carrier about four to six inches thereabove. This U-shape opening allows the interior of the garment carrier to be accessed rather completely and more satisfactory than would a straight zipper down the center of the inside panel, or a diagonal zipper across the inside panel. Additionally, if one wishes to have a diagonal opening, one could open slide fastener 37 along the top and down the left side of the garment carrier 10 thereby defining an access panel that would fold diagonally across the L-shape slide fastener opening. The portion of inside panel 12 defined by the U-shaped zipper or slide fastener 37 defines an inside access panel 40 which is affixed along its right hand side to piping 35. Panel 40 is double sided so as to include a pair of pockets 41 and 42, with each pocket having an upper opening defined by slide fasteners 43, 44, respectively. With respect to the opposing side panel 11 of the garment carrier of the present invention, the opening in pocket 42 defined by slide fastener 44 is positioned spatially subjacent the spine strap 22 on panel 11 so that pocket 42 is substantially vertical when the garment carrier is folded and carried by a user either grasping handle 24 or using a shoulder strap (not shown) attached to strap loops 23—23. Adjacent the bottom of inside panel 12 and below the U-shape opening cover 40, another pocket 45 formed inside inner panel 12 such that its upper opening is defined by slide fastener 46 with the pocket extending inwardly and downwardly therefrom. Thus, the outside panel 11 and inside panel 12, and the various pockets and accessories formed therein and attached thereto have been shown and described along with the elongate side panel 13 and the expandable backfoldable side panel portion 34 which is retained in retracted or folded position by slide fastener 36, within the scope of the present invention.

Figure 6:
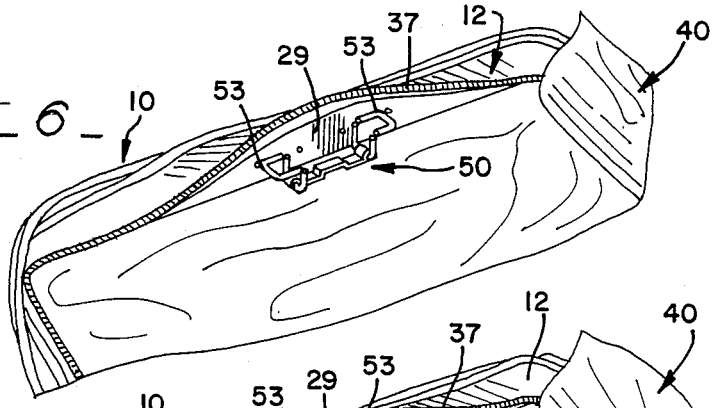
FIG. 6 is an enlarged detailed fragmentary view of the interior of the top of the garment carrier showing the dual hanger retainer as it appears in articulated or folded position.
Figure 7:
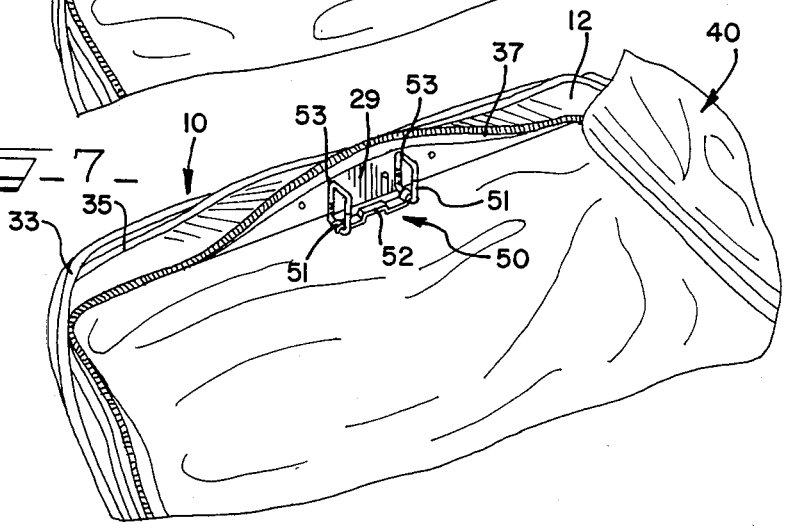
FIG. 7 is an enlarged fragmentary perspective view similar to FIG. 6 showing the dual hanger retainer in extended or expanded position.
Figure 8:
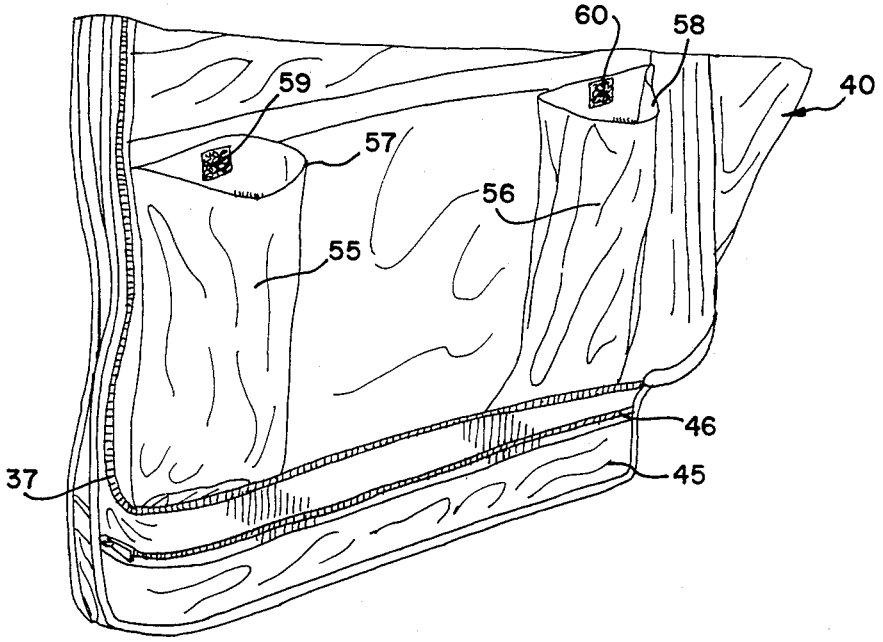
FIG. 8 is a fragmentary enlarged perspective view of the interior of the garment carrier showing a pair of pockets positioned therein suitable for receiving and retaining shoes therein.

Referring to FIGS. 6, 7 and 8, a substantially flat base plate 29 extends across the thickness of garment carrier 10, interiorly adjacent the upper end of the side panel 13 so as to provide a mounting for handle 28 at the top of the garment carrier. On the inner side of base plate 29 is positioned a dual articulated hanger retaining assembly, generally indicated at 50. The articulated assembly 50 includes a pair of hinged, generally rectangular, hanger retaining loop bases 51—51 mounted to the base plate 29, with the inner vertical portions of same rigidly connected by a bridging member 52. The combination of plate 29, the rectangular loop bases 51—51 and bridging portion 52 define a three dimensional rigid assembly capable of supporting hangers on the lower portion of loop bases 51—51. Hingedly articulated to each of the loop bases 51—51 is a substantially identical articulated loop half 53—53 which is hingedly moveable from a folded or articulated position shown in FIG. 6 where each member 53 is swung outwardly of the base loop portions 51—51 to an extended or expanded position, shown most clearly in FIG. 7, wherein the articulated portions 53—53 and the base portions 51—51 form a generally rectangular loop having a bottom side which is approximately double the hanger carrying capacity of the bottom side of base member 51 when the articulated loop portion 53 is folded. It should be noted that suits or garments are mounted on each of hanger loops 51, 53 in a position offset to the center of the garment carrier. This offset hanger positioning allows more garments to be positioned in the available space than if a single central hanger retainer is utilized.

In the preferred embodiment, articulated dual hanger retaining assembly 50 is formed of metal for rigidity, strength and a durable hinged center portion. However, it will be understood that the hanger retaining assembly may be made of other materials, such as plastic. Thus, an expandable articulated dual hanger retaining assembly has been shown and described in accordance with the present invention. It will be understood that the size of the hanger assembly, when in folded or articulated position, is able to retain a sufficient number of hangers on each half loop to fill the interior of the garment carrier 10 when same is in retracted position having a thickness as substantially shown in FIG. 4. With the articulated dual hanger retainer assembly 50 as shown in FIG. 7, the outermost portions of articulated loop portions 53—53 are intended to extend beyond the height or thickness of piping 33 as shown in FIG. 4 so as to provide sufficient hanger retaining capacity to fill the interior of the garment carrier when the extendable side panel is in extended position as shown in FIG. 5. Generally, the positioning of the articulated dual hanger retaining assembly 50 in its extended position causes the garment carrier to approximate the size of a four-suiter garment carrier, whereas the articulated dual hanger retaining assembly 50, when in folded position as shown in FIG. 6 is adapted to retain the number of garments generally associated in the trade with filling a two-suiter garment carrier.

Referring to FIG. 8, the interior of the bottom of garment carrier 10 is shown with the inside panel U-shaped cover 40 in folded back or open position to uncover a pair of vertical pockets 55–56 each having an upper opening 57, 58, respectively, which, in this embodiment, is closable by means of hook and loop fastener portions 59–60, respectively. Pockets 55 and 56 are sized to be able to retain shoes, house slippers, or the like in vertical spaced apart position within the interior of the garment carrier. Thus, if a traveller desires to take a second pair of shoes, or house slippers on a trip with him or her, the shoes may be neatly retained in vertical spaced apart position instead of being shoved in the bottom of the garment carrier where they may be loose, moveable or otherwise not properly retained.

While one embodiment of the present invention has been shown and described, it is understood by those skilled in the art that changes and modifications may be made without departing from the invention in its broader aspect. Therefore, the aim of the appended claims is to cover all such changes and modifications as fall within the true spirit and scope of the present invention.

The invention is claimed as follows:

1. In a generally rectangular garment carrier of the type being foldable along a transverse fold line, said garment carrier including a generally rectangular outside panel and a similarly shaped inside panel, each joined along its periphery to at least one edge of an elongate side panel extending therearound, and means for manual user carrying of said garment carrier when in folded position, an improvement comprising:

means for backfolding at least a portion of said side panel along its width substantially around the periphery of said garment carrier and selectably releasably maintaining same in backfolded condition to define the base size of said garment carrier, and to define the expanded size of said garment carrier when said portion of said side panel is released to a fully extended position, and expandable means for hanger support positioned adjacent one end of the interior of said garment bag, said expandable means for hanger support, when in expanded position, fitting within said garment carrier when said side panel is in a fully extended position.

2. The garment carrier as defined in claim 1 wherein said means for backfolding and selectably releasably maintaining said portion of said side panel in backfolded position include an elongate slide fastener with one half of same positioned adjacent and along a peripheral joinder between said side panel and one of said outside panel and said inside panel, and the other half of same positioned along the length of said side panel substantially midway thereon between said outside panel and said inside panel.

3. The garment carrier as defined in claim 2 wherein the material for a backfoldable portion of said side panel is lighter weight material than that used for the remainder of said side panel.

4. The garment carrier as defined in claim 1 wherein a backfoldable portion of said side panel is positioned between piping normally associated with an inside edge of a side panel and said inside panel, with said means for backfolding said side panel being substantially invisible to said outside panel and an unfolded portion of said side panel when said garment carrier is in folded position.

5. The garment carrier as defined in claim 1 wherein said expandable means for hanger support include a base member secured on a portion of said side panel at one end of the interior of said garment bag, a pair of hanger retainers mounted on said base member and offset to either side of a longitudinal centerline of said garment carrier, and adjustable means on each of said hanger retainers for selectably expanding the hanger carrying capacity of each.

6. The garment carrier as defined in claim 5 wherein each of said pair of hanger retainers includes a closed looped rod mounted on said base member at a top portion of said rod, and including a substantially straight bottom portion thereof on which external hangers may be releasably affixed.

7. The garment carrier as defined in claim 6 wherein each of said closed loop rods is made of rigid material, and is articulated at two opposing portions thereof allowing a frontal portion of said closed loop rod to selectably swing into and out of alignment with said substantially straight bottom portion thereof to extend the length of same and increase the hanger retaining capability of said closed loop rod.

8. The garment carrier as defined in claim 1 wherein said means for manual user carrying are positioned adjacent said transverse fold line, and said garment carrier further includes a pair of spaced apart vertically oriented pockets positioned on an interior of said garment carrier between said outside panel and said inside panel, said pockets each including an opening adjacent the top thereof and means for selectably closing same, and each of said pockets being sized for fitting a shoe therein and maintaining same in substantially vertical position therein.

* * * * *